US005483044A

United States Patent [19]

Thorneywork et al.

[11] Patent Number: 5,483,044

[45] Date of Patent: Jan. 9, 1996

[54] MICROWAVE HEATING WITH HOT AND COLD AIR STREAMS

[75] Inventors: Nigel Thorneywork, Normandy; Aubrey B. Jelly, Guildford, both of England

[73] Assignee: Merrychef Limited, Hampshire, United Kingdom

[21] Appl. No.: 261,547

[22] Filed: Jun. 17, 1994

[30] Foreign Application Priority Data

Jun. 25, 1993 [GB] United Kingdom ..... 9313171

[51] Int. Cl.[6] ..... H05B 6/80; H05B 11/00

[52] U.S. Cl. ..... 219/681; 219/757; 219/400; 126/21 A

[58] Field of Search ..... 219/681, 682, 219/685, 757, 400; 126/21 A

[56] References Cited

U.S. PATENT DOCUMENTS

| | | | |
|---|---|---|---|
| 3,692,968 | 9/1972 | Yasuoka | 219/681 |
| 3,878,350 | 4/1975 | Takagi | 219/757 |
| 3,884,213 | 5/1975 | Smith . | |
| 4,409,453 | 10/1983 | Smith . | |
| 4,481,396 | 11/1984 | Matsubayashi et al. | 219/681 |
| 4,591,683 | 5/1986 | Eke | 219/757 |
| 4,608,474 | 8/1986 | Kohka | 219/681 |
| 5,166,484 | 11/1992 | Young . | |
| 5,166,487 | 11/1992 | Hurley . | |

FOREIGN PATENT DOCUMENTS

| | | |
|---|---|---|
| 57-188942 | 11/1982 | Japan . |
| 63-131931 | 6/1988 | Japan . |
| 63-180021 | 7/1988 | Japan . |
| 3000020 | 1/1991 | Japan . |
| 1463657 | 2/1977 | United Kingdom . |
| WO90/08449 | 1/1990 | WIPO . |

*Primary Examiner*—Philip H. Leung
*Attorney, Agent, or Firm*—M. Lukacher

[57] ABSTRACT

A microwave oven cavity 2 is provided by a magnetron(s) with microwave energy for providing heat in the thermal cavity. Hot air is supplied by a heated air supply and director (21,22,24). Cool air, at least a portion of which is able to assist in containing and/or directing at least a portion of said hot air, is also supplied via a sleeve (31) so as to provide localization of at least a portion of said hot air in the thermal cavity, and optionally to prevent or reduce heat reaching at least a portion of the boundary of the thermal cavity.

10 Claims, 12 Drawing Sheets

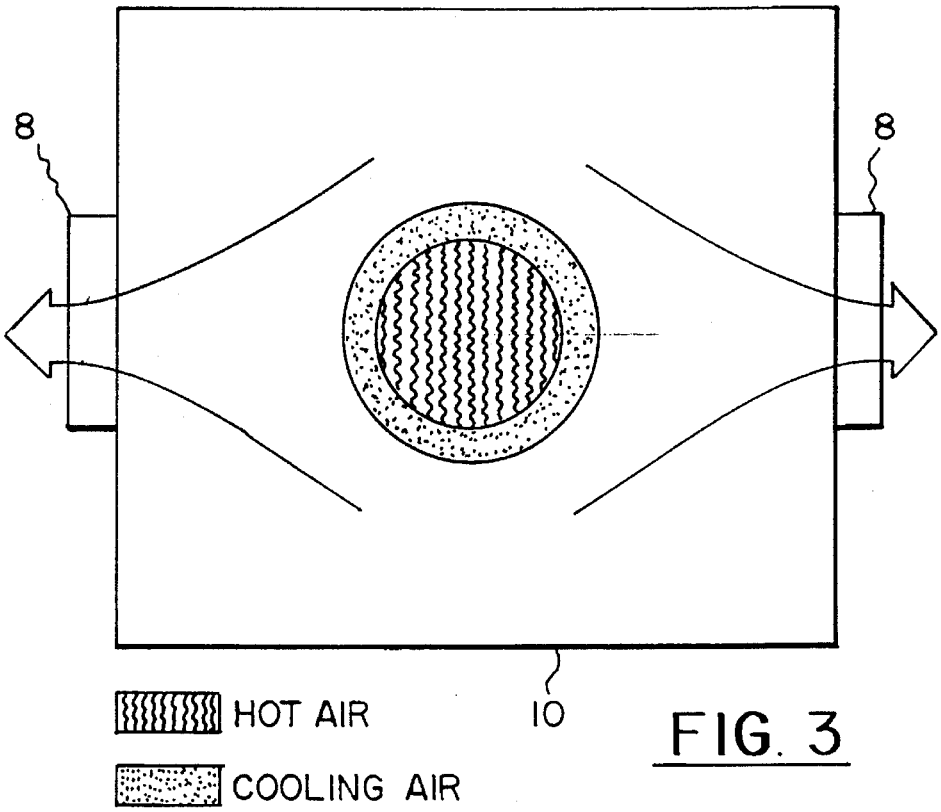
FIG. 3
FIG. 2
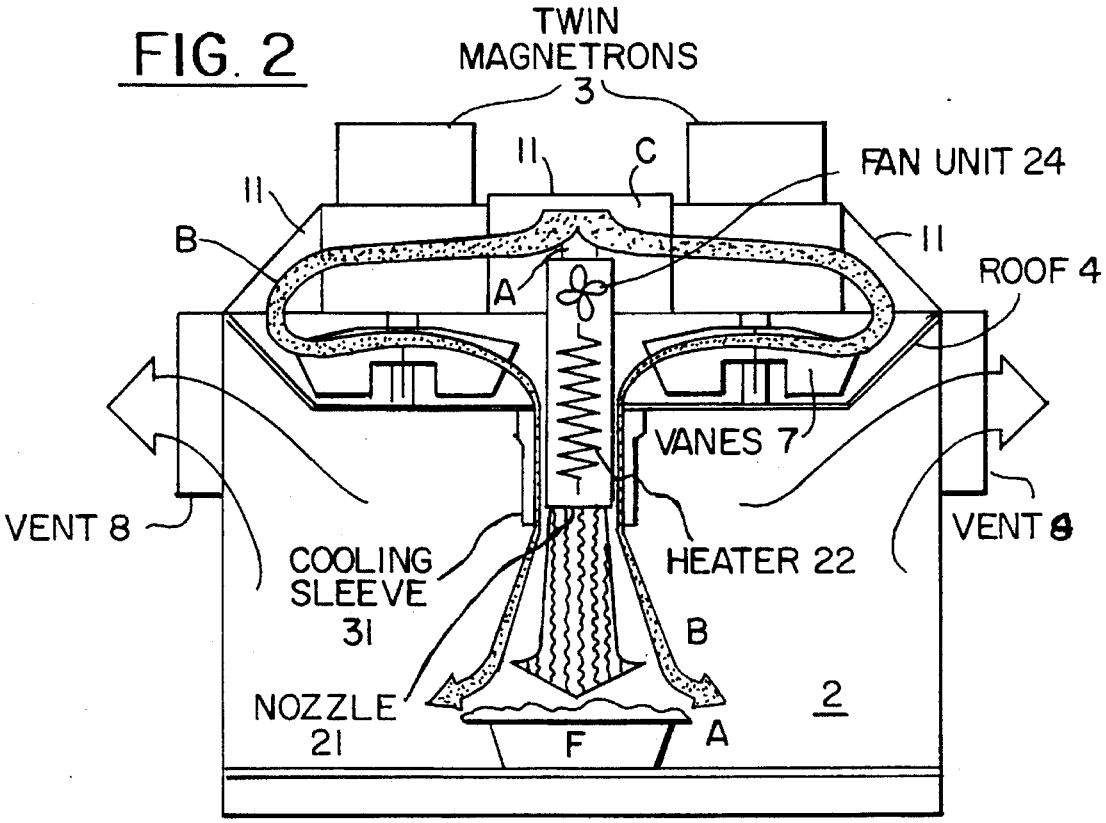

MICROWAVE HEATING WITH HOT AND COLD AIR STREAMS

There is continuing need to improve microwave heating, especially microwave cooking. Various uncooked or pre-cooked food products may be cooked or further cooked in a conventional microwave oven or other suitable thermal cavity, using only microwave energy, but the results may be unappetising. For example, the use of only microwave energy to cook pastry(s) may result in the pastry(s) attaining a soggy texture, compared with the results obtained from a conventional hot air oven or a conventional combination hot air/microwave oven, but both of these ovens require preheating to more than 200 and retain heat for a long time after cooking has ceased.

It has now been found in accordance with the present invention that at least one of the problems of texture, preheating, and heat retention may be prevented or reduced by providing in addition to at least one source of microwave energy:

(a) at least one supply of suitably hot air for adding or enabling suitable quality(s), e.g. browning and/or crispness, of a food item (e.g. any suitable food product);

(b) at least one supply of air cooler than said hot air, at least a portion of the supplied cool air being able to assist in containing and/or directing at least a portion of said hot air (i.e. the at least one supply of cooler air may be regarded as a thermal resistance), so as to provide localisation (e.g. to concentrate) of at least a portion of said hot air in the region of the food item, and optionally to prevent or reduce heat reaching at least a portion of the boundary (e.g. side wall(s) and/or door) of the thermal cavity containing the food item.

In general, however, the present invention is not restricted to cooking applications. Thus, the invention is applicable to providing improved microwave heating for any other suitable application, e.g. laboratory use.

According to a first aspect of the invention, there is provided apparatus comprising a thermal cavity (e.g. microwave oven cavity), which apparatus comprises:

at least one microwave means for providing microwave energy for providing heat in the thermal cavity at suitable time(s);

at least one first supply means, for supplying suitably hot air to the thermal cavity at suitable time(s); and at least one second supply means, for supplying suitably cool air, at least a portion of which is able to assist in containing and/or directing at least a portion of said hot air, so as to provide localisation (e.g. to concentrate) of at least a portion of said hot air in the thermal cavity, and optionally to prevent or reduce heat reaching at least a portion of the boundary of the thermal cavity.

A second aspect of the invention provides a method of heating, comprising utilising at least one apparatus of the first aspect of the invention.

The present invention may be embodied in suitable manner(s). One example is a microwave oven for any suitable application(s) and any suitable manner(s) of operation. Some applications are commerical e.g. vending (for instance by coin or token), domestic, industrial, laboratory, scientific, or technical applications. Some manners of operation are manual operation, or programmed operation (e.g. preprogrammed operation comprising operational information stored in a preprogrammed system for use in vending), or automatic operation. Any suitable logic means (e.g. utilising fuzzy logic and/or other logic) may be utilised. If desired, the apparatus may comprise means for preheating or be otherwise adapted to provide preheating.

The microwave means may be embodied in any suitable manner(s). For example, the apparatus may comprise at least one magnetron and/or at least one semi-conductive solid state device. The microwave energy provided may be at any suitable frequency(s), e.g. substantially 2.5 Ghz. The microwave energy may be adjustable or fixed; it may be substantially consistent, e.g constant.

The first supply means, for supplying suitably hot air, may be embodied in any suitable manner(s). One example of the first supply means comprises at least one first aperture means for delivering hot air, preferably comprising at least one nozzle means. The at least one first supply means may further comprise at least one heater means for heating air. For example, a said nozzle means may comprise at least one electrical heater (for instance a variable output heating element). The hot air supplied from the at least one first supply means may have any suitable configuration, e.g. comprise at least one jet stream, for instance delivered from at least one orifice (e.g. circular aperture) comprised by the output end(s) of the at least one nozzle means. Preferably, the at least one first supply means will not transmit microwave energy. The hot air supplied may be delivered at any suitably hot temperature, eg. fixed or variable. Some examples of suitable temperatures are hot temperatures up to substantially 800° C. (e.g. 800° C.).

Preferably, the at least one second supply means will be sustantially transparent to microwave energy.

The second supply means, for supplying suitably cool air, may be embodied in any suitable manner(s). One example of the second supply means comprises at least one sleeve means for surrounding at least one said first supply means (e.g. a said nozzle means) but spaced therefrom to provide at least one duct down which at least a portion of said cool air may flow between at least one said second supply means and the at least one said first supply means. The at least one second supply means may obtain suitable air from any suitable source(s), e.g. cool air that has been utilised for providing cooling of at least one said microwave means. The cool air supplied to the at least one second supply means may have any suitable temperature(s), e.g. at least room temperature(s), for instance in the range substantially 0° C. to substantially 35° C. The cool air may become heated in its travel to the at least one second supply means. The cool air may become heated when flowing in contact with the at least one first supply means but will be cool relative to the hot air, e.g. substantially different in temperature.

The hot air discharged from said at least one first supply means and/or the cool air discharged from said at least one second supply means may be discharged in any suitable configuration(s) from the thermal cavity. For example, the hot air and cool air may pass to at least one optional outlet vent that may be comprised by the cavity, for instance to two outlet vents optionally present and respectively at the upper regions of opposite side walls of the thermal cavity. The at least one outlet vent may vent at least a portion of any unwanted moisture generated and/or released by a food product, etc. during operation of the apparatus.

It will be appreciated that hot and/or cooler air may be provided for other purpose(s) in the thermal cavity, e.g. such that the flow rate and/or temperature of such air will prevent or resist formation of condensation on the inwardly facing surface of e.g. a door to the thermal cavity, if such a door is present.

In general, the apparatus of the first aspect of the invention may be controlled in any suitable manners. For example, control may be provided to control combinations and/or in any suitable order(s): microwave energy, or cool air, or cool air, and hot air, or microwave energy and hot air and cool air. Control may be provided for any suitable period(s) of time. Some examples of combinations of control are: pulsing of hot air and/or pulsing of cool air; and/or pulsing of microwave energy; and/or any other suitable variation(s) of operating parameter(s), e.g. variation(s) of power source input(s), etc. One example of preferred control is when the supply of cool air and/or the supply of hot air is discontinued or terminated at any suitable time(s) after completion of cooking, so as further to enhance the cooked products.

The apparatus of the first aspect of the invention may comprise at least one control means for controlling at least one function of the apparatus. For example, the apparatus may comprise: at least one control means for controlling operation of the at least one microwave means; and/or at least one control means for controlling operation of the at least one first supply means; and/or at least one control means for controlling operation of the at least one second supply means.

The apparatus of the first aspect of the invention may comprise at least one temperature control means for controlling exit temperature(s) of the hot air being delivered from the at least one first supply means, preferably being delivered from at least one said nozzle means. Said at least one temperature control means may comprise at least one sensor for sensing temperature (e.g. at least one thermocouple) for contacting said hot air being delivered from the at least one first supply means, e.g. from said at least one nozzle means, this at least one temperature control means being able to output at least one control signal to which at least one logic means (optionally comprised by the apparatus, e.g. as mentioned earlier above) may respond to aid or maintain substantially consistent (e.g. constant) temperature of the hot air exiting from the at least one first supply means, e.g. from at least one said nozzle means. Preferably, at least a portion of at least one said temperature control means is located outside the exit region(s) of at least one said nozzle means, thereby preventing or resisting receipt of microwave energy from said thermal cavity by the at least one temperature control means. Preferably, the at least one temperature control means enables the hot air exiting from the at least one first supply means to have temperatures in the range substantially 100° C. to substantially 800° C., e.g. substantially 350° C. for one example of a microwave oven. Such a temperature may be adjustable or fixed. Such temperatures will be chosen to correspond to any intended application of the apparatus, e.g. temperature(s) suitable for uncooked or cooked foodstuff(s), for instance pastry(s), etc.

One example of the temperature control is in regeneration of commercially available deep frozen (substantially −18° C.) food products, for instance in regeneration of deep frozen chips, deep frozen fish, or frozen toasted sandwiches, etc.

Some further examples of providing control of operation(s) are given later below in the description of the accompanying drawings.

Optional cooler means may be comprised by the apparatus of the first aspect of the invention, or be separate from that apparatus, so as at least partly to cool air supplied to the apparatus for any purpose(s), e.g. to the at least one second supply means. Some examples of cooler means are a water cooled heat exchanger or a refrigerator.

In the accompanying drawings, which are by way of example of the present invention:

FIG. 2 shows schematically some air flows in the oven of FIG. 1.

FIG. 3 is a cross section of a hot jet airsteam surrounded by a sleeve of cooler air.

Figure 1:
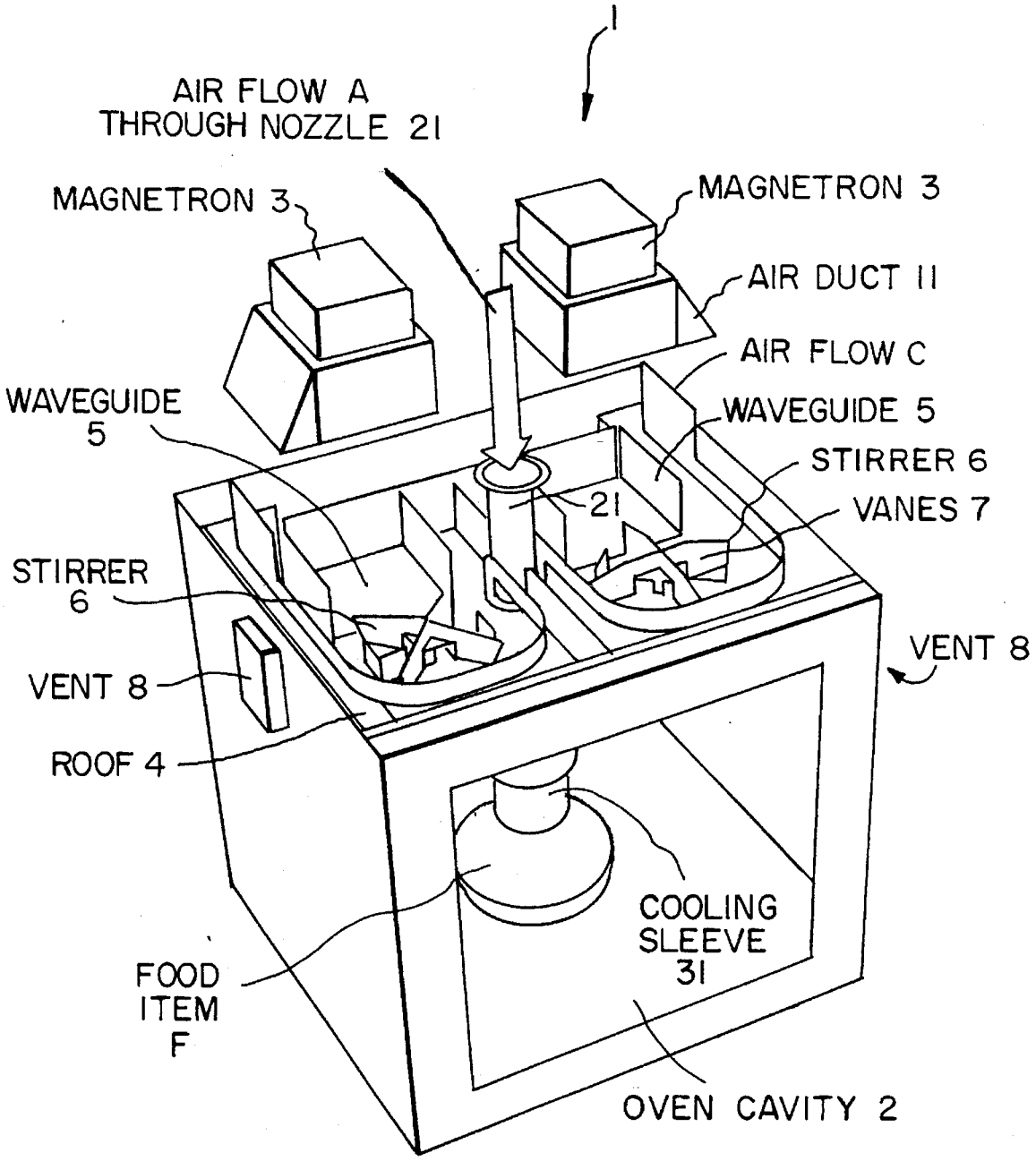
FIG. 1 shows schematically one example of a microwave oven.

In FIG. 1, a microwave oven 1 has a thermal cavity 2 (i.e. the oven cavity) for receiving microwave energy from two magnetrons 3 mounted above the roof 4 of cavity 2, via two waveguides 5 and two stirrers 6 having rotatable vanes 7 comprising mica. Rotation of the vanes 7 is provided by an airflow B described later below. Vanes 7 enable an even distribution of microwave energy to pass downwards through roof 4 and into oven cavity 2. Oven 1 has two outlet vents 8 (FIGS. 1,2) for allowing air from cavity 2 to pass outwards, e.g. to the ambient atmosphere. Roof 4 is transparent to microwave energy and may comprise any suitable material(s), e.g. polymeric materials, for instance flame retardant polypropylene(s). Preferably, roof 4 is electrically insulating.

Figure 4:
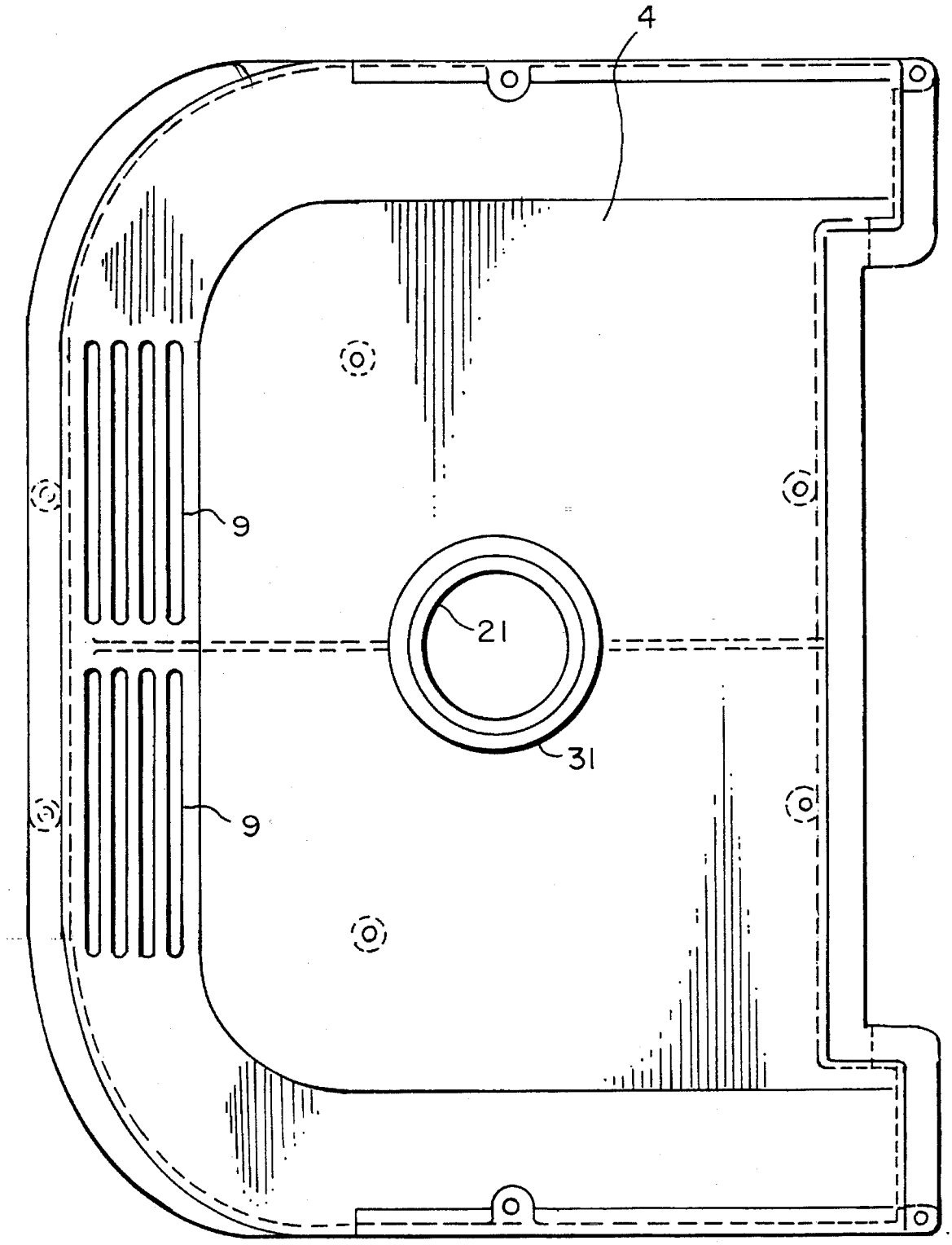
FIG. 4 is an upward view of the roof of the oven of FIG. 1.
Figure 5:
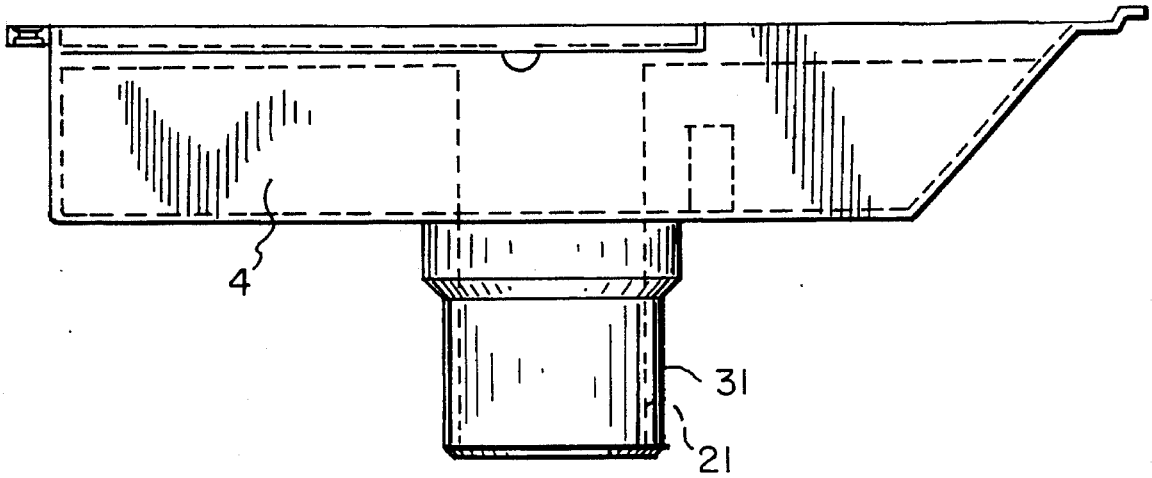
FIG. 5 is a left side view of the roof of FIG. 4.
Figure 10:
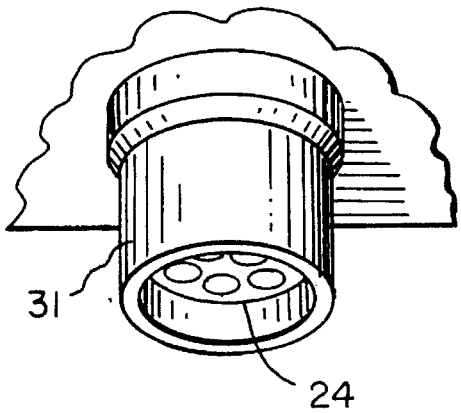
FIG. 10 is a fragmentary view corresponding to FIG. 4, and shows the discharge ends of a nozzle and a circumjacent sleeve.
Figure 6:
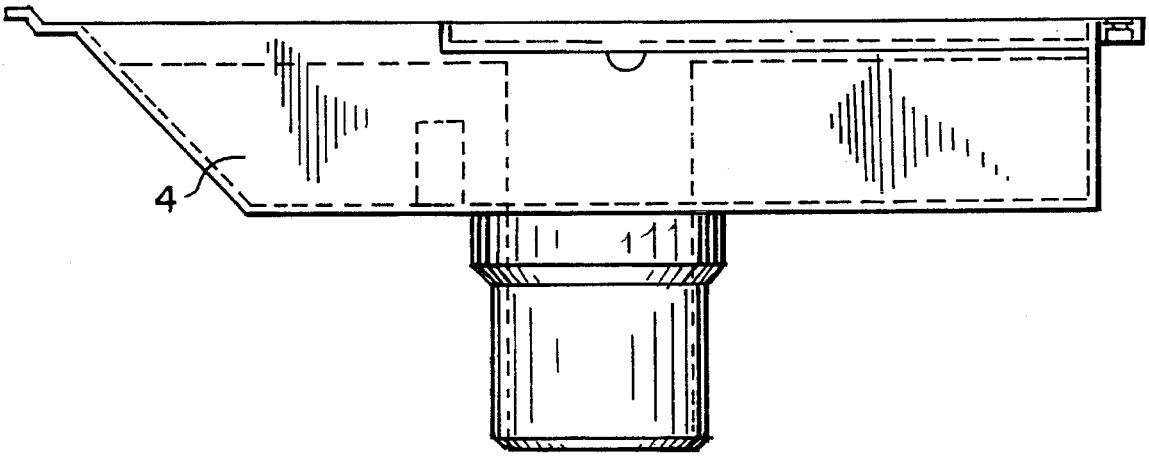
FIG. 6 is a right side view of the roof of FIG. 4.
Figure 7:
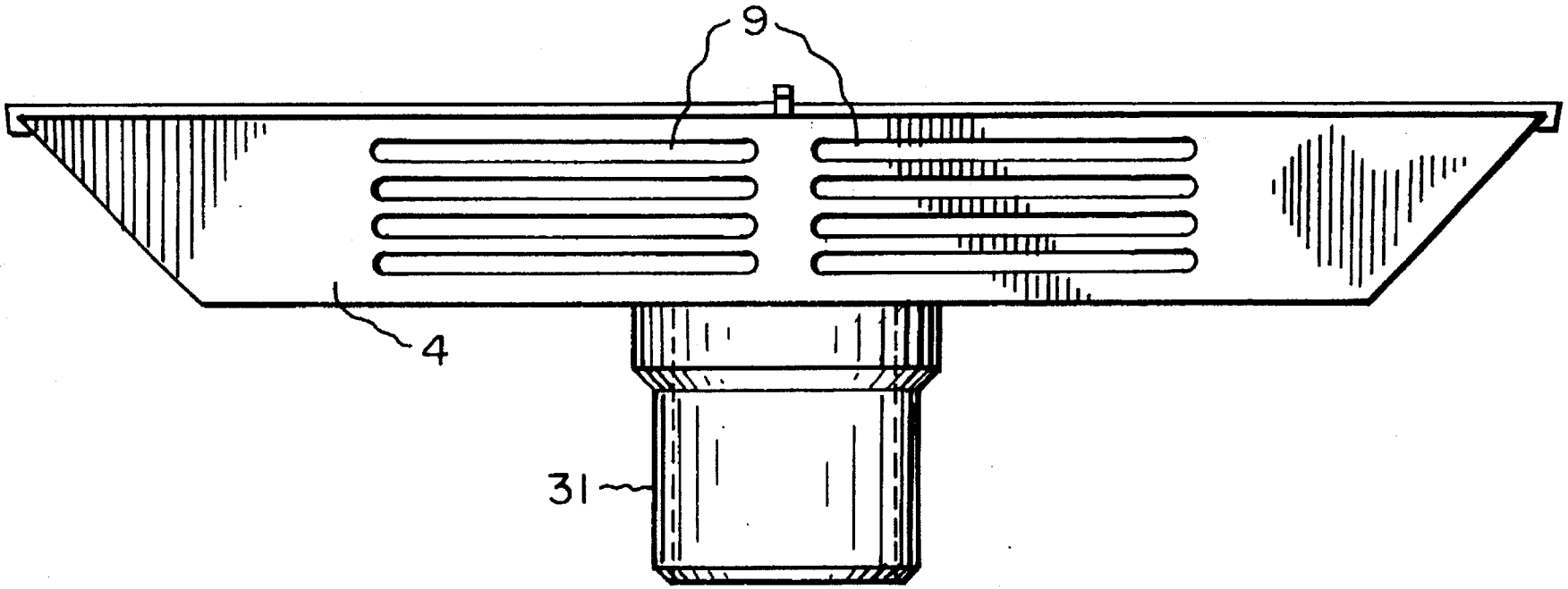
FIG. 7 is a front view of the roof of FIG. 4.
Figure 8:
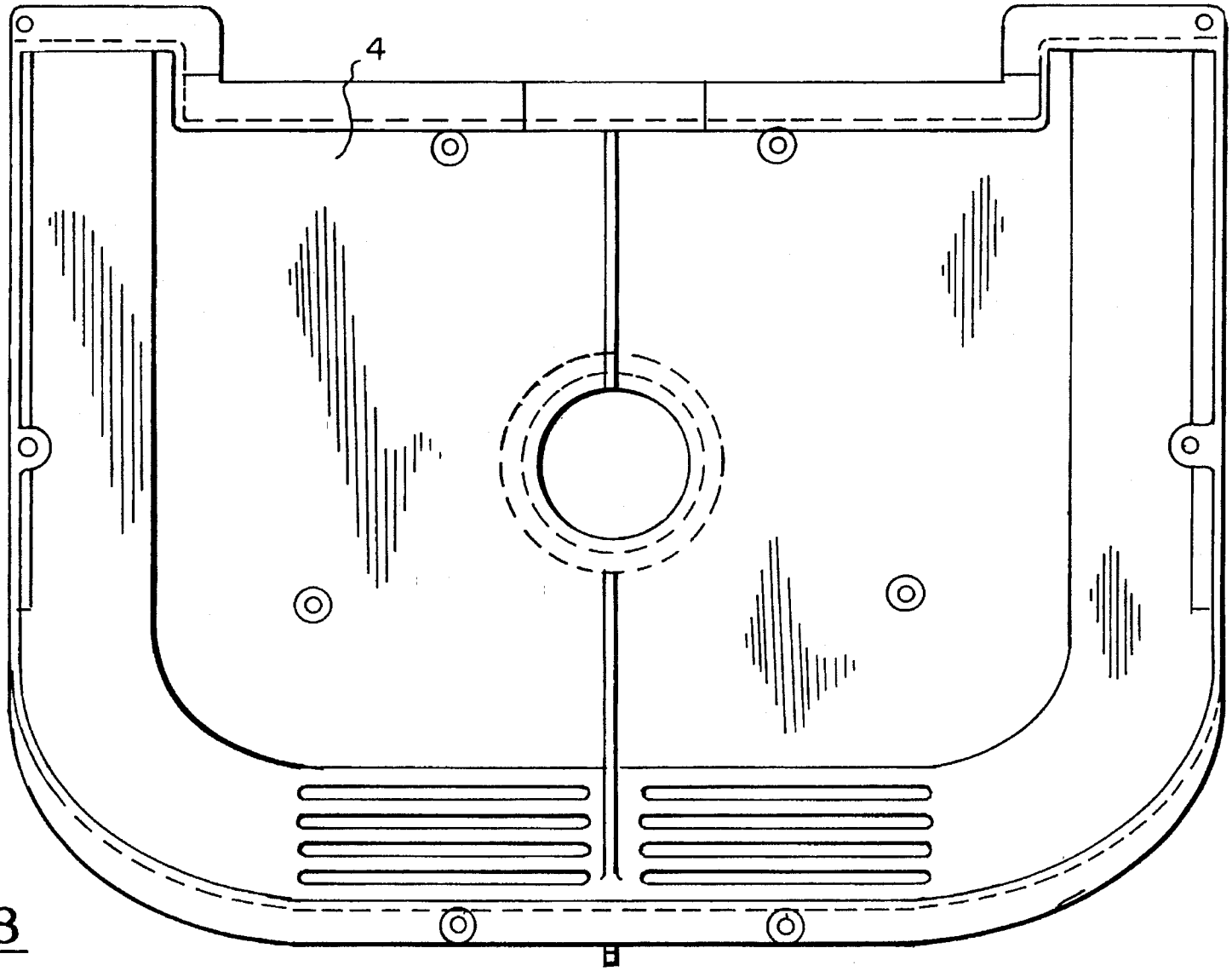
FIG. 8 is a downwards view of the roof of FIG. 4.
Figure 9:
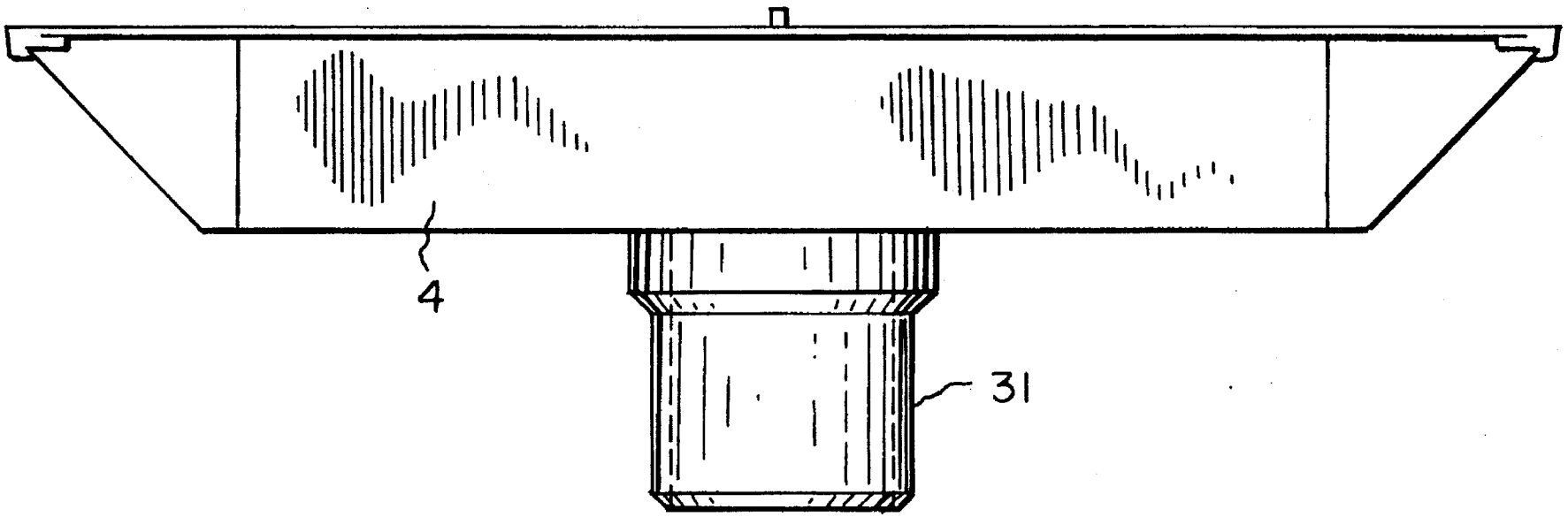
FIG. 9 is a rear view of the roof of FIG. 4.

Ambient air is drawn into an inlet duct 11, by a suitable fan (not shown) cooperating with that duct. This received air provides three portions A,B,C of flowing air. Air portion A passes to nozzle 21 described later below. Air portion B provides cooling of the magnetrons, and then passes via stirrers 6 (and rotates their vanes 7) and into an annular passage between nozzle 21 and a circumjacent sleeve 31 described later below. Air portion C passes to outlet slots 9 (FIG. 4) in the front portion of the underneath of roof 4, and thence into oven cavity 2 and towards the inwardly facing surface of door 10 (FIG. 3) of cavity 2, such that the flow rate and/or temperature of this air will prevent or resist formation of condensation on the inwardly facing surface of door 10 (FIG. 3) of cavity 2. Air portion C is optional. It may be provided by air portion B after that portion has cooled the magnetrons.

Nozzle 21 and fan unit 24 comprise one example of at least one said first supply means, for supplying hot air to the thermal cavity 2. Nozzle 21 (FIG. 11, 12, 13, 14) includes a variable output electrical resistance heater 22 within a spaced apart circumjacent electrically conductive metal cylinder or housing 23 comprises longitudinal ducts 25 for air. Nozzle 21 receives portion A of air via fan unit 24, such that portion A may be heated, and then discharged via ducts 25 and circular outlet nozzle holes 26 comprised by the discharge end of cylinder 24. Ducts 25 and holes 26 have sizes to prevent or resist transmission therethrough of microwave energy. The discharged heated air portion A is directed as jet streams towards a food item F provided on the bottom of or on an optional shelf of oven cavity 2. Cylinder 23 may comprise any suitable material(s), e.g. metals(s) or metal(s) coated onto ceramic(s).

Figure 15:
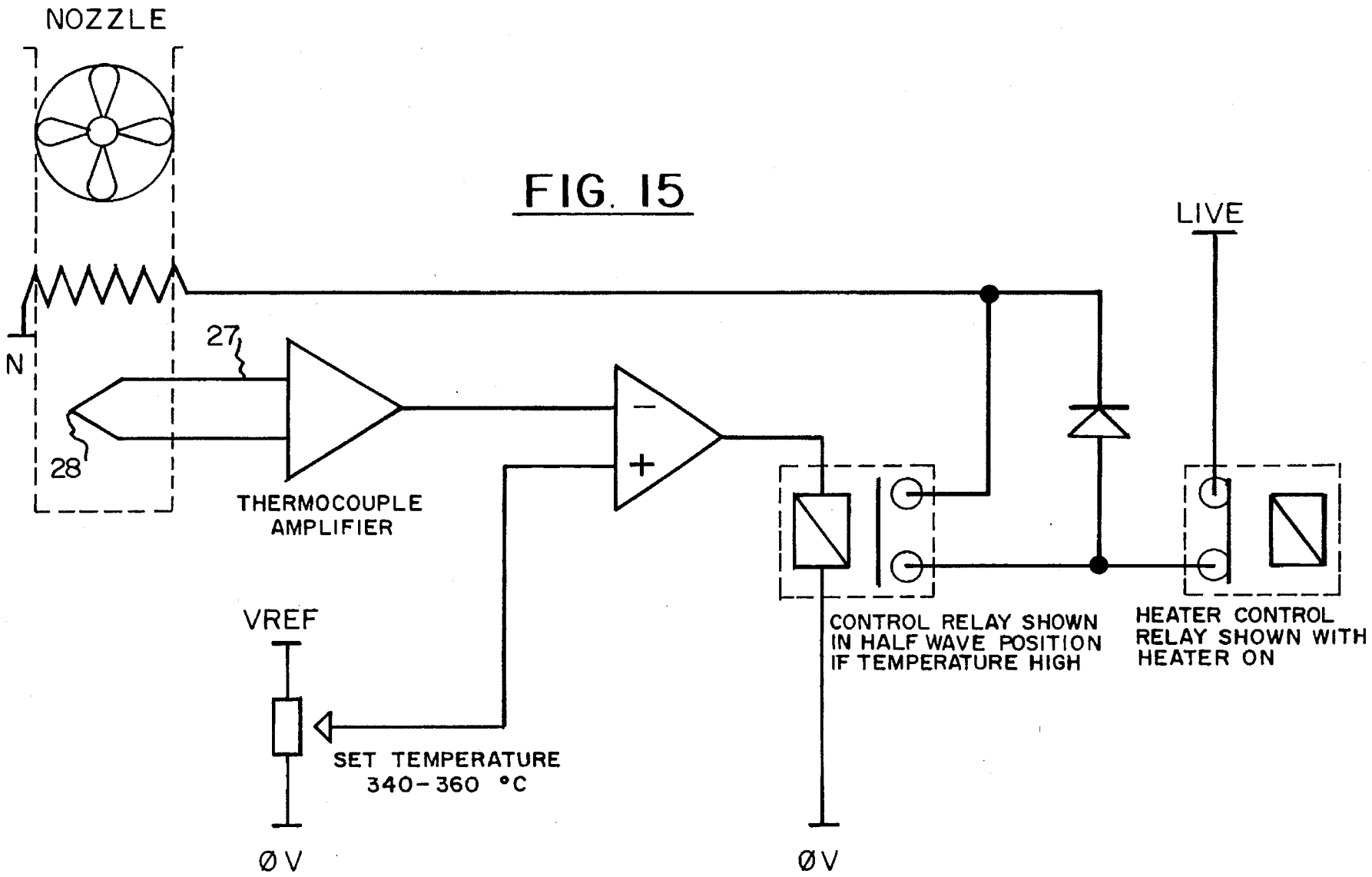
FIG. 15 shows one example of a temperature control circuit comprising the thermocouple sensor of FIG. 13, to control heating provided by the heating element.

A thermocouple 27 extends longitudinally through heater 22, so that the sensor tip 28 of the thermocouple protrudes from the heater and into the heated air being discharged therefrom. The thermocouple outputs at least one signal for enabling temperature control of the heater 22, and hence control of temperature of the discharging hot air. The at least one signal can be procesed by the heating control circuit shown in FIG. 15. It is possible for the heater 22 to be switched to half wave rectified mains current rather than completely off, whereby thermal shock to the heater is reduced and its life is extended.

Figures 11, 12:
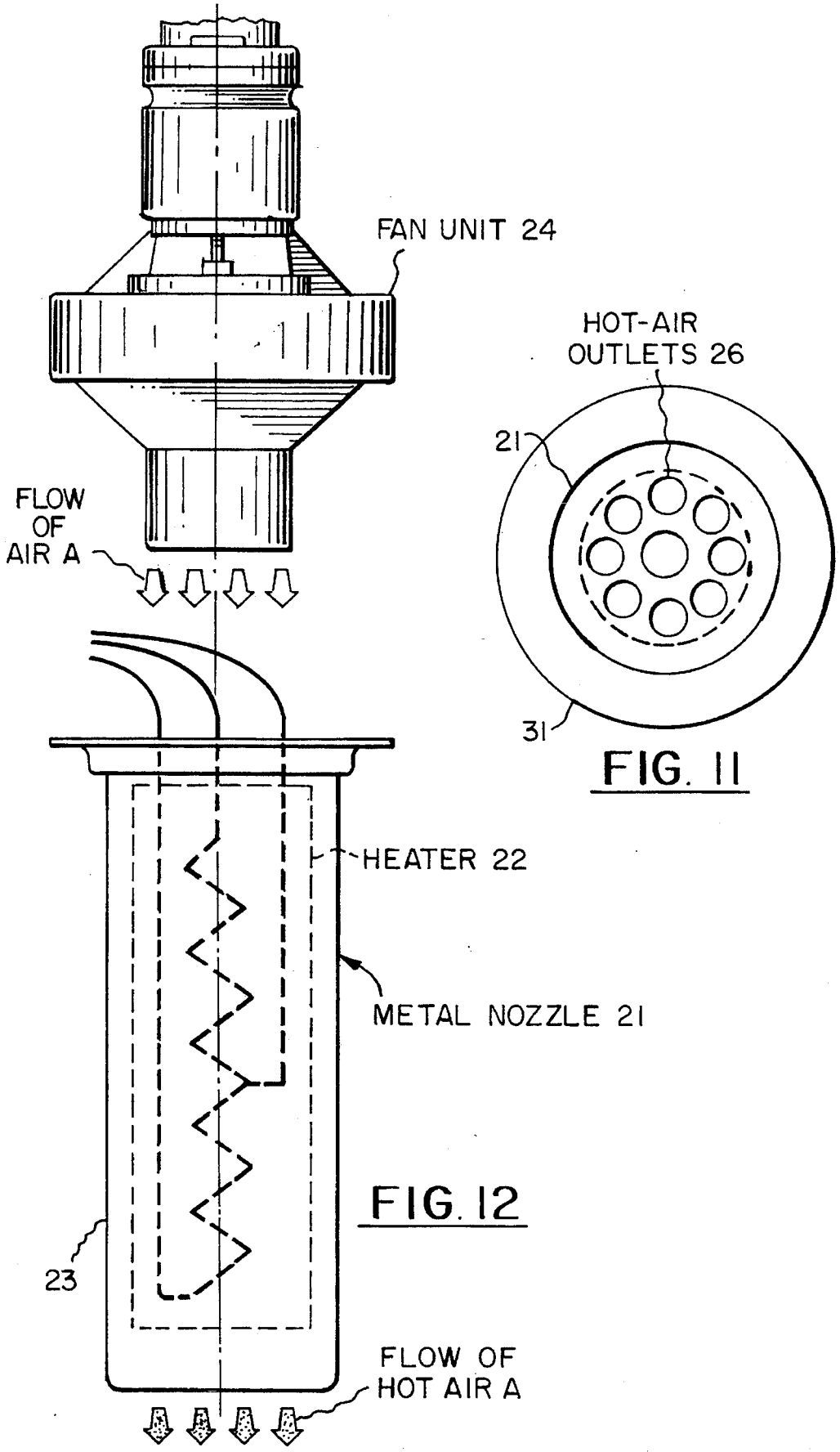
FIG. 11 is an upwards view of the discharge ends shown in FIG. 10.
FIG. 12 is a schematic view of the nozzle of FIG. 10, and a heater and a fan unit.
Figure 13:
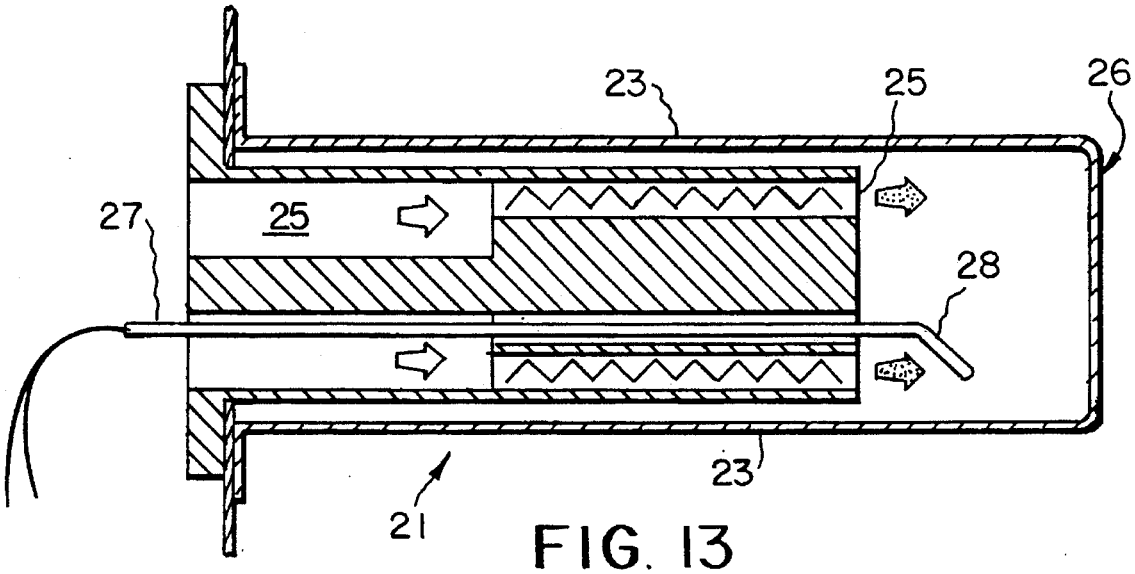
FIG. 13 is a sectional view of one of example the nozzle of FIG. 12, showing a heater with a thermocouple temperature sensor.
Figure 14:
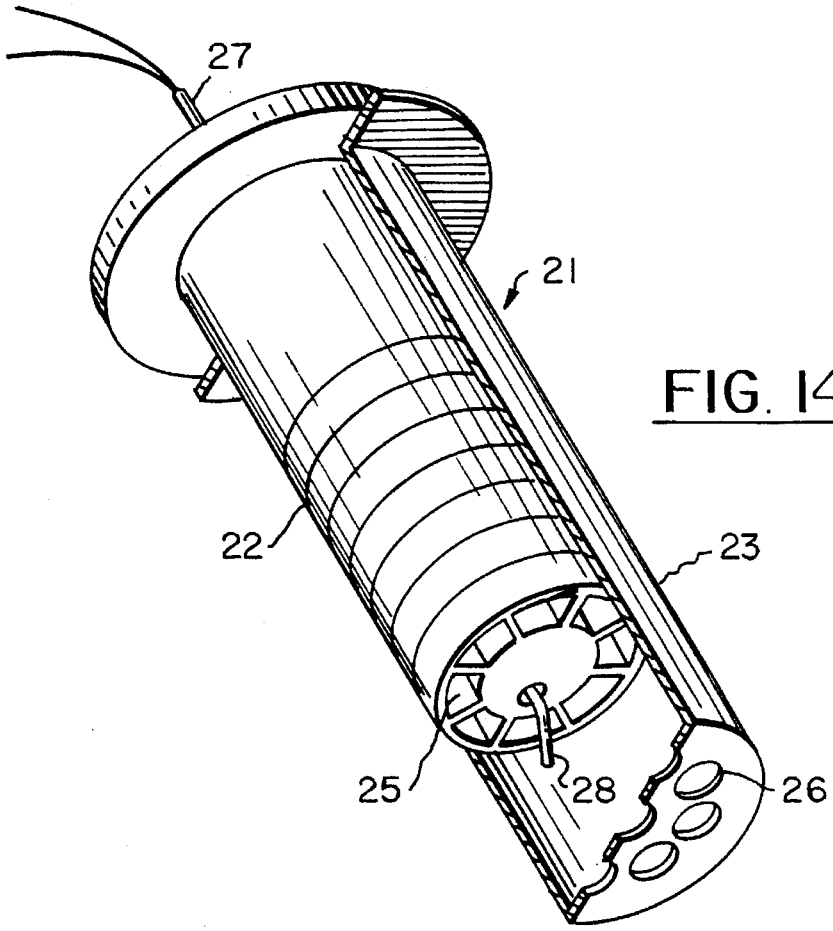
FIG. 14 is fragmentary view corresponding to FIG. 13.
Figure 16:
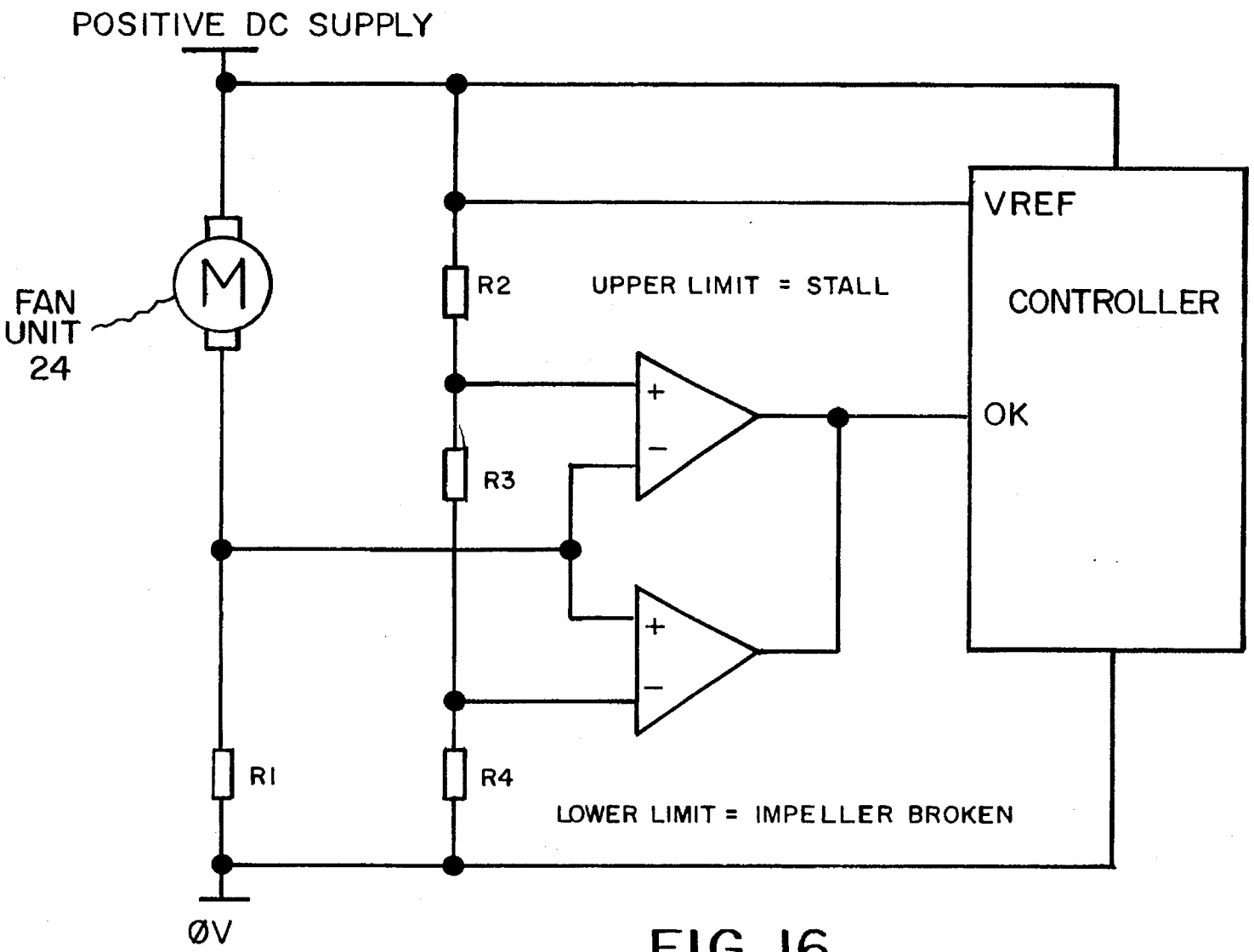
FIG. 16 shows one example of a fan monitor control circuit, to control the fan unit of FIG. 12.

FIG. 16 shows a fan monitor control circuit for fan unit 24 of FIG. 12. This circuit can prevent the heater 22 from being energised if there is a fault with the fan unit, and is a window comparator that may be used to see whether or not the fan unit is operating correctly. The fan monitor control circuit prevents the heater from burning out due to insufficent air flow.

Some examples of providing control of operation(s) are: controlling nozzle temperature by varying the fan speed of the fan unit; measuring temperature by monitoring the heating element resistance; and monitoring input voltages and/or currents, to control the input power to the heater.

Sleeve 31 is one example of at least one said second supply means, for supplying cool air to the thermal cavity 2. Sleeve 31 is preferably electrically insulating, and may comprise any suitable material(s), e.g. polymeric materials (for instance polytetrafluoroethylenes, or ceramic materials). Relatively cool air B passes from the discharge end of sleeve 31 into the oven cavity 2, and downwards as a circumjacent column, jacket, mantle, or sleeve of cool air B relative to the discharged hot air portion A, at least a portion of the discharged cool air assisting in containing and/or directing (optionally to concentrate) at least a portion of the discharged hot air, so as to provide localisation of at least a portion of the discharged hot air, and to prevent or reduce heat reaching at least a portion of the boundary (e.g. the door and/or sides) of the oven cavity 2, this heat being provided by the discharged hot air portion A.

The cool air B enables at least one of the problems of texture, preheating, and heat retention (described earlier above) to be prevented or reduced, e.g. in respect of food items that are pastry(s), etc.

It will be appreciated that the above mentioned discharged cool air will provide localisation (e.g. to concentrate) of at least a portion of the hot air in the oven cavity 2, and optionally prevent or reduce heat reaching at least a portion of the boundary of the cavity. In general, this localisation may be provided in any suitable manners and in any suitable configurations.

The oven described with reference to the drawings may comprise any suitable control means, and/or least one cooler means (not shown), as described earlier above.

The present invention as exemplified in the drawings may be embodied in any suitable manners as described above before the first reference to the drawings.

No restriction is placed upon the nature of the apparatus of the first aspect of the invention other than suitability for use according to the application(s) and operation(s) required.

The present invention includes equivalents and modifications arising from all the disclosures of the present specification and its accompanying drawings.

We claim:

1. Apparatus having a microwave oven cavity, said apparatus comprising:

at least one microwave means for providing microwave energy in said microwave oven cavity at least one first supply means for downwardly supplying in said microwave oven cavity a column of hot air, downwardly directed to the region of an item to be heated by said microwave energy in said cavity; and at least one second supply means for downwardly supplying in said microwave oven cavity a downwardly directed column of cool air relative to said downwardly directed column of hot air, said at least one second supply means being sufficiently surrounding and spaced apart from said at least first supply means such that said downwardly directed column of cool air is circumjacent said downwardly directed column of hot air so that said column of hot air is localized in said region by means of said column of downwardly directed cool air.

2. Apparatus as claimed in claim 1, wherein said at least one microwave means comprises at least one magnetron.

3. Apparatus as claimed in claim 1, wherein said at least one first supply means comprises at least one nozzle means for supplying said downwardly directed column of hot air.

4. Apparatus as claimed in claim 3, wherein said at least one nozzle means comprises discharge outlets for supplying jet streams of said hot air such that said downwardly directed column of hot air comprises jet streams of said hot air.

5. Apparatus as claimed in claim 1, wherein said at least one first supply means comprises at least one heater means for heating air to be comprised by said column of hot air.

6. Apparatus as claimed in claim 5, wherein said at least one heater means comprises at least one electrical resistance heater.

7. Apparatus as claimed in claim 1, wherein said at least one second supply means comprises at least one sleeve means surrounding and spaced apart from said at least one said first supply means such that said downwardly directed column of cool air is circumjacent said downwardly directed column of hot air.

8. Apparatus as claimed in claim 7, comprising at least one temperature control means for controlling temperature of said hot air being supplied from said at least one first supply means.

9. Apparatus as claimed in claim 1, comprising at least one outlet vent for venting from said region, air from said localization of columns of hot and cool air.

10. Apparatus as claimed in claim 1, comprising at least one control means for controlling said apparatus.

* * * * *